US005095923A

United States Patent [19]

Kramer

[11] Patent Number: 5,095,923

[45] Date of Patent: Mar. 17, 1992

[54] TOBACCO EXPANSION PROCESS USING 1,1,1,2-TETRAFLUOROETHANE

[75] Inventor: Anatoly I. Kramer, Winston-Salem, N.C.

[73] Assignee: R. J. Reynolds Tobacco Company, Winston-Salem, N.C.

[21] Appl. No.: 683,636

[22] Filed: Apr. 11, 1991

[51] Int. Cl.[5] ..... A24B 3/18

[52] U.S. Cl. ..... 131/296; 131/290; 131/293

[58] Field of Search ..... 131/293, 296, 291, 299

[56] References Cited

U.S. PATENT DOCUMENTS

| | | | |
|---|---|---|---|
| 3,524,451 | 8/1970 | Fredrickson . | |
| 3,524,452 | 8/1970 | Moser et al. . | |
| 3,683,937 | 8/1972 | Fredrickson et al. . | |
| 3,765,425 | 10/1973 | Stungis et al. . | |
| 3,842,846 | 10/1974 | Laszlo . | |
| 3,870,053 | 3/1975 | Heitkamp et al. | 131/299 |
| 3,881,498 | 5/1975 | Wochnowski . | |
| 4,153,063 | 5/1979 | Roselius et al. . | |
| 4,235,250 | 11/1980 | Utsch . | |
| 4,258,729 | 3/1981 | de la Burde et al. . | |
| 4,289,148 | 9/1981 | Ziehn . | |
| 4,336,814 | 6/1982 | Sykes et al. . | |
| 4,461,310 | 7/1984 | Ziehn . | |
| 4,531,529 | 7/1985 | White et al. . | |
| 4,561,452 | 12/1985 | Gahrs . | |

FOREIGN PATENT DOCUMENTS

| | | |
|---|---|---|
| 0280817 | 12/1987 | European Pat. Off. . |
| 0323699 | 11/1988 | European Pat. Off. . |

*Primary Examiner*—V. Millin
*Assistant Examiner*—Lynne A. Reichard
*Attorney, Agent, or Firm*—Grover M. Myers

[57] ABSTRACT

The invention is directed to a process for expanding tobacco wherein tobacco is impregnated with gaseous 1,1,1,2-tetrafluoroethane and thereafter heated in an expansion zone to liberate the 1,1,1,2-tetrafluoroethane and cause expansion of the tobacco. The process of the invention can provide substantial expansion of tobacco cut filler lamina without substantial generation of tobacco fines and employing substantially mild pressures of, for example, less than about 3,000 psi and with minimal effect on tobacco flavor.

41 Claims, 2 Drawing Sheets

TOBACCO EXPANSION PROCESS USING 1,1,1,2-TETRAFLUOROETHANE

BACKGROUND OF THE INVENTION

The invention relates to a process for tobacco expansion. More specifically, the invention relates to a process for expanding tobacco to reduce its bulk density and thereby increase its volume and filling capacity. The process is especially suitable for treating cigarette cut filler.

In the past two decades, tobacco expansion processes have become an important part of the cigarette manufacturing process. Tobacco expansion processes are used to restore tobacco bulk density and/or volume which are lost during curing and storage of tobacco leaf. In addition, expanded tobacco is an important component of many low tar and ultra low tar cigarettes.

Commercially significant tobacco expansion processes are proposed in U.S. Pat. Nos. 3,524,451 to Fredrickson and 3,524,452 to Moser et al. These patents describe processes wherein tobacco is contacted with a volatile organic impregnant and then heated by rapidly passing a stream of hot gas in contact with the impregnated tobacco to volatilize the impregnant and expand the tobacco. A variation of these processes is proposed in U.S. Pat. No. 3,683,937 to Fredrickson et al. which discloses a tobacco expansion process wherein tobacco is impregnated with a volatile organic compound in the vapor state and in the absence of any liquid or solid phase. The impregnated tobacco is expanded such as by heating with a stream of hot gas.

Following development and commercialization of the tobacco expansion processes described above, extensive and continuing efforts have been directed to the identification of specific expansion agents and processes for expansion of tobacco. For example, U.S. Pat. Nos. 4,235,250 to Utsch; 4,258,729 to Burde et al and U.S. Pat. No. 4,336,814 to Sykes et al among others, propose the use of carbon dioxide for expanding tobacco. In these and related processes, carbon dioxide, either in gas or in liquid form, is contacted with tobacco to impregnate tobacco and thereafter the carbon dioxide-impregnated tobacco is subjected to rapid heating conditions to volatilize the carbon dioxide and thereby expand the tobacco. Carbon dioxide is a substantial component of the atmosphere and is readily available. Nevertheless, in the carbon dioxide tobacco expansion processes, it is typically necessary to heat the expanded tobacco excessively in order to achieve substantial stable expansion. This can result in degrading and even harming the tobacco flavor and the generation of excessive amounts of tobacco fines. In addition, those commercially available processes which use liquid carbon dioxide to impregnate tobacco result in impregnated tobacco in the form of solid blocks of tobacco containing dry ice which must be broken up prior to heat treatment, thereby degrading and possibly harming the tobacco and increasing the complexity of the process.

U.S. Pat. Nos. 4,461,310 to Zeihn and 4,289,148 to Zeihn propose the expansion of tobacco employing liquid nitrogen or argon impregnation of tobacco. These gases are removed from the tobacco during a rapid pressure reduction and the tobacco is expanded by exposure to heated gas. These processes require treatment of tobacco at pressures in excess of 2,000 or 4,000 psi up to above 10,000 psi in order to achieve substantial tobacco expansion although expansion is still low.

U.S. Pat. No. 4,531,529 to White et al proposes a process for increasing the filling capacity of tobacco wherein the tobacco is impregnated with a low-boiling and highly volatile expansion agent such as a normally (e.g., at ambient conditions) gaseous halocarbon or hydrocarbon at process conditions above or near the critical pressure and temperature of the expansion agent. The pressure is quickly released to atmospheric and the tobacco expands without the necessity of a heating step to either expand the tobacco or to fix the tobacco in the expanded condition.

U.S. Ser. No. 459,007, filed Dec. 29, 1989 proposes a process for expanding tobacco by exposure to sulfur hexafluoride.

Various processes have been proposed for the microwave treatment of tobacco to provide tobacco expansion in U.S. Pat. Nos. 3,765,425 to Stungis et al; 3,842,846 to Laszio et al; and 3,881,498 to Wochnowski, among others. In the Stungis et al disclosure, tobacco is treated to increase its moisture level or to impregnate the tobacco with an organic expansion agent which absorbs microwaves. Alternatively, the tobacco is treated with an organic expansion agent which does not absorb microwaves, in combination with water and thereafter in any case, the tobacco is exposed to microwave energy to volatilize the moisture and/or organic expansion agent, resulting in tobacco expansion.

Numerous other compounds have been proposed or suggested for expanding tobacco including alkanes, alkenes, alcohols, aldehydes, ketones and ethers. In most instances, various practical problems are encountered however, such as the extraction of desirable flavors from the tobacco during the impregnation step and/or the expansion step; insufficient amount of tobacco expansion; non-uniformity of expansion; reactions between the expansion agent and various components in tobacco; adverse impact on tobacco processing equipment; high levels of retained residual in the final expanded tobacco; and/or hazards such as flammability associated with expansion agents.

There has thus continued to be a search for improvements in known tobacco expansion processes and for new and improved tobacco expansion processes and agents, in general. Yet despite the continuing efforts, commercial success in the field of tobacco expansion has been limited.

SUMMARY OF THE INVENTION

The invention provides a tobacco expansion process which employs 1,1,1,2-tetrafluoroethane as the expansion agent. It has been found that 1,1,1,2-tetrafluoroethane can be used to expand tobacco without substantial physical degradation to the tobacco and without significant change of tobacco taste and flavors. The process of the invention is conducted by impregnating tobacco with 1,1,1,2-tetrafluoroethane which is advantageously in gaseous form and maintained at a pressure of greater than about 600 psi at above about 102° C. Preferably, the impregnation step is conducted at a pressure of between about 1500 psi and 3000 psi and the gas is in its supercritical state. The impregnated tobacco is discharged from the impregnation zone at a temperature between about 5° C. and about 80° C., preferably between about 10° C. and about 50° C. At these temperature conditions, the tobacco is in a substantially pliable state and will retain between about 0.5% to about 3.0%, preferably between about 0.7% to about 2.0% by weight, 1,1,1,2-tetrafluoroethane. The impregnated tobacco is thereafter heated rapidly in an expansion zone to liberate the retained 1,1,1,2-tetrafluoroethane and thereby expand the tobacco. Relatively mild heating conditions of between for example, 90° C. and 300° C., advantageously between about 160° C. and 250° C. can be successfully employed to achieve substantial tobacco expansion of greater than 50% increase in filling power.

The expansion agent used in the process of this invention, 1,1,1,2-tetrafluoroethane, is an odorless and tasteless gas at room temperature. It is available under the trademark Suva HFC-134a from DuPont, Corpus Christi, Tex. At atmospheric pressure, its boiling point is about −26.2° C. and its freezing point is about −96.6° C. Despite its low boiling and freezing points, it has been found that 1,1,1,2-tetrafluoroethane is retained by tobacco at temperatures between about 5° C. and about 80° C., advantageously between about 10° C. and about 50° C., for short periods of time, thus allowing time for transport of impregnated tobacco to a heated expansion zone or for the temporary storage of the impregnated tobacco in an insulated or refrigerated holding zone. Typically, 1,1,1,2-tetrafluoroethane is retained in the tobacco in amount ranging from about 0.5% by weight to about 3.0% by weight.

At suitable impregnation temperatures of above the critical point of 1,1,1,2-tetrafluoroethane e.g., above about 102° C. to about 140° C., preferably above about 115° C., impregnation of 1,1,1,2-tetrafluoroethane into tobacco has been found to be both rapid and thorough and to permeate the tobacco; thus, impregnation times of less than 15 minutes, for example, about 0.5 to about 10 minutes are conveniently employed. Impregnation pressures used in the process of the invention, although superatmospheric, are not excessive (e.g., greater than 3000 psi). Because relatively mild temperatures can be employed to expand the impregnated tobacco of the invention, tobacco fines generation can be minimized and the impact on tobacco flavor and taste due to heating can be eliminated or minimized. Moreover, there is little 1,1,1,2-tetrafluoroethane retention by the expanded tobacco.

Still another benefit of the expansion process of the invention is that under the impregnation temperatures and pressures employed herein, there is advantageously little if any extraction of valuable flavor components from the tobacco during the impregnation step. Thus, the tobacco removed from the impregnation zone can advantageously be in a substantially unextracted condition. This preserves the flavor in the expanded tobacco and also allows for simplification of impregnant recovery steps.

In one advantageous embodiment of the invention, 1,1,1,2-tetrafluoroethane impregnated tobacco can be expanded employing a microwave treatment. In this embodiment, the tobacco is preferably treated prior to impregnation to provide a moisture content of greater than 15%, preferably between about 25% and about 40%. Following impregnation, the tobacco is rapidly passed through a microwave heating zone. Although 1,1,1,2-tetrafluoroethane absorbs only minor amounts of microwave energy, the moisture present in the tobacco will absorb microwave energy and generate heat to rapidly volatilize the 1,1,1,2-tetrafluoroethane expansion agent. Because the volatilization of moisture and 1,1,1,2-tetrafluoroethane during the microwave heat treatment exerts a cooling effect, the tobacco is maintained at temperatures of less than 100° C. throughout the heating step. The expanded tobacco can be recovered at a moisture content of, for example, between 7% and 13% by weight, thus eliminating or minimizing the need for a separate, reordering treatment following tobacco expansion.

BRIEF DESCRIPTION OF THE DRAWINGS

In the drawings which form a portion of the original disclosure of the invention.

DESCRIPTION OF THE PREFERRED EMBODIMENTS

Various preferred embodiments of the invention are described below. It will be understood however that the invention is not limited to the described embodiments; to the contrary, the invention includes various alternatives, modifications and equivalents within its spirit and scope as will be apparent to the skilled artisan.

Tobacco to be treated in the expansion process of the invention can be provided in any of various forms, for example in the form of leaf, strip or cigarette cut filler. Shredded tobacco of 20 to 40 cuts per inch, i.e., cut filler, is preferred because the process is more effective with this smaller particle size and also some of the increase in filling capacity may be lost if expanded tobacco in the form of leaf or strip were subsequently run through a cutter or shredder. If desired, the tobacco may be cased with various flavorants, humectants and the like prior to expansion treatment.

The tobacco to be treated should be in a pliable condition to minimize breakage or shattering during handling and processing. The traditional way of making tobacco pliable is to adjust the water content to within the range of between about 10 and about 40%, preferably between about 20 and about 40% moisture. Higher moisture contents also can be, and advantageously are, employed in the process of the invention, particularly when microwave treatment is used to expand the tobacco.

Figure 1:
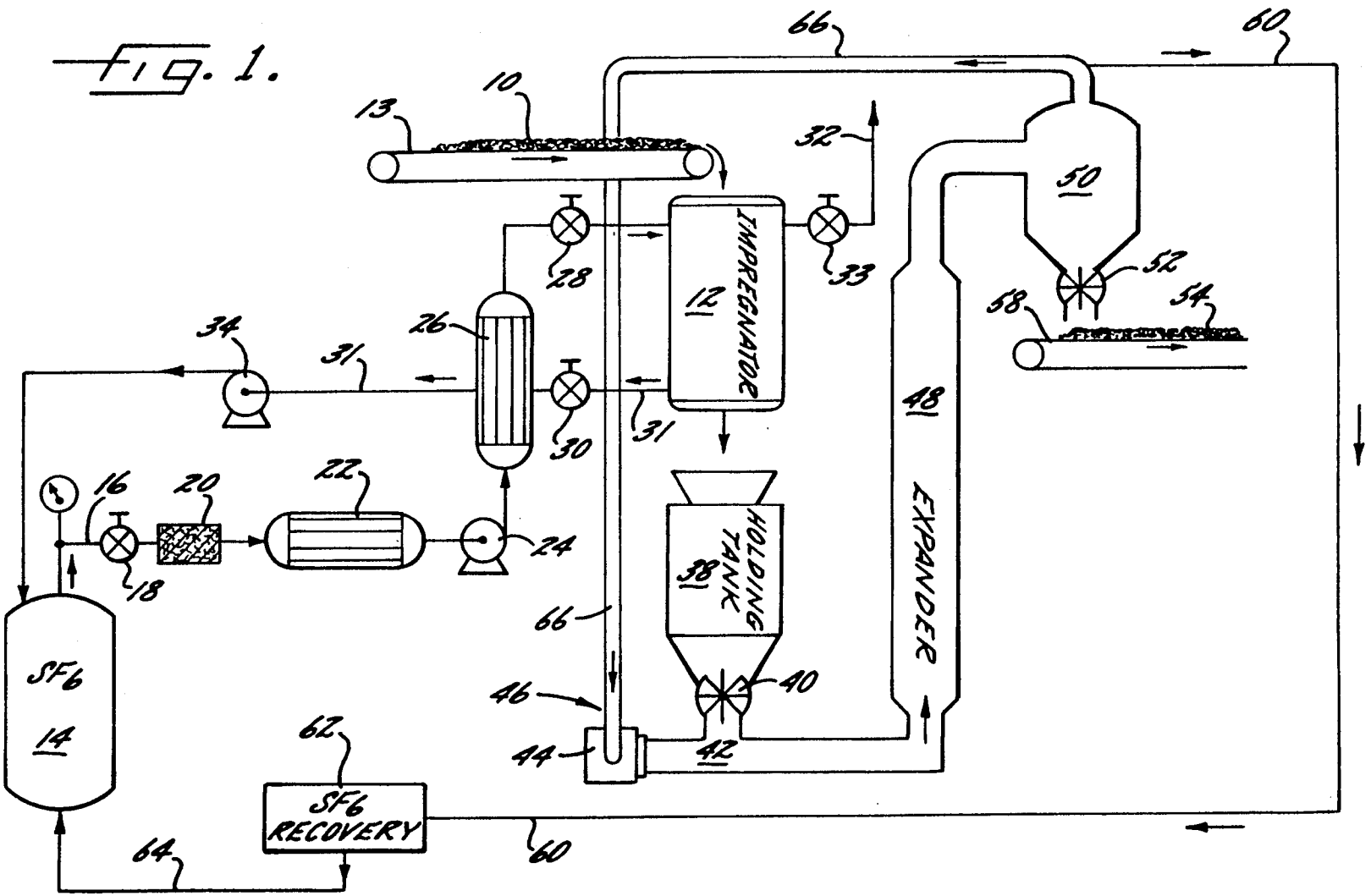
FIG. 1 schematically illustrates one preferred embodiment of the invention wherein tobacco is impregnated with 1,1,1,2-tetrafluoroethane; discharged from the impregnation zone; and passed to a hot air column for expansion of the tobacco.

With reference to FIG. 1, tobacco, 10 which is preferably in the form of cigarette cut filler is passed to a batch impregnation zone 12 via a conventional loading means such as a conveyor 13. As illustrated in FIG. 1, the impregnator 12 constitutes a batch-type high pressure vessel, such as will be known to the skilled artisan. Any of various and numerous arrangements and accessories can be employed for the pressure vessel. The vessel should advantageously include a valved inlet, in the vessel for admitting 1,1,1,2-tetrafluoroethane and a valved outlet for removing 1,1,1,2-tetrafluoroethane. Plural valved outlets at both the top and bottom of the vessel can be employed. In addition, a heating or cooling means, such as an external heated jacket, heating coils, or a cooling jacket can be optionally employed in order to maintain the 1,1,1,2-tetrafluoroethane and tobacco at an impregnating temperature of above about 102° C., preferably between about 115° C. and about 140° C.

Returning to FIG. 1, a supply of 1,1,1,2-tetrafluoroethane 14, such as a pressurized storage tank containing liquid 1,1,1,2-tetrafluoroethane, provides 1,1,1,2-tetrafluoroethane through line 16 via valve 18 to a filter 20 and then to heat exchanger 22 wherein the 1,1,1,2-tetrafluoroethane is cooled or chilled in order to reduce cavitation and to insure performance of a liquid high pressure pump. The chilled liquid 1,1,1,2-tetrafluoroethane is pumped by means of high pressure liquid pump 24 through a heat exchanger 26 which heats the liquid 1,1,1,2-tetrafluoroethane to convert it to a gas and at the desired temperature of between for example about 105° C. and about 170° C., preferably greater than about 130° C. The temperature of the 1,1,1,2-tetrafluoroethane exiting heat exchanger 26 will likely be different than the desired impregnation temperature since the temperature of the tobacco will affect the temperature of the 1,1,1,2-tetrafluoroethane upon mixing. Thus the 1,1,1,2-tetrafluoroethane can advantageously be heated to a temperature of, for example, about 130° C. to about 170° C. Upon addition of the 1,1,1,2-tetrafluoroethane to the tobacco via valve 28, the system will reach an equilibrium temperature of between, for example, about 115° C. to about 140° C.

The 1,1,1,2-tetrafluoroethane in the impregnator is preferably maintained in gaseous form once the vessel has been filled and equilibrium reached and is advantageously supplied in sufficient amount to fully impregnate the tobacco with the 1,1,1,2-tetrafluoroethane. The pressure can range from about 1500 psi to about 3000 psi or greater with pressures of between about 2200 psi and about 2500 psi being preferred. Advantageously, the temperature during impregnation is maintained at above the critical point, i.e., greater than about 102° C., preferably greater than about 130° C. to maintain the 1,1,1,2-tetrafluorethane as a gas. Under these conditions a short impregnation time ranging from about 0.5 to about 30 minutes, preferably between about 2 and about 15 minutes is employed.

Following impregnation for a suitable amount of time, valve 30 is opened allowing 1,1,1,2-tetrafluoroethane to exit impregnator 12 via line 31. As the gas exits via line 31, the temperature within the impregnator 12 will decrease. If heating has been employed during the impregnation step, it can be advantageously discontinued to allow the impregnated tobacco to cool as the gaseous 1,1,1,2-tetrafluoroethane is removed from the impregnator. Depending on impregnation temperatures and pressures, both upper and lower gas removal lines 32 and 31, respectively, can be employed for removal of 1,1,1,2-tetrafluoroethane, or only a single line can be used. 1,1,1,2-tetrafluoroethane gas exiting from impregnator 12 is passed to a conventional recovery zone (not shown) for recovery of the 1,1,1,2-tetrafluoroethane which is then returned to supply tank 14.

Excessive cooling is to be avoided during removal of the 1,1,1,2-tetrafluoroethane in order to prevent the formation of large, solid blocks of tobacco. Thus, the temperature of the tobacco following discharge of the impregnant is best kept between about 5° C. and 80° C., preferably between about 10° C. and about 50° C., most preferably between about 10° C. and about 30° C. at which temperatures the impregnated tobacco will be in a substantially pliable form. By "substantially pliable", it is meant that no large frozen solid blocks of tobacco will be formed which need to be broken up prior to heat treatment.

The gaseous 1,1,1,2-tetrafluoroethane removed from the impregnator is passed via line 31 through a pump 34 and following any necessary treatment for removal of solids, moisture, or other contaminants, is returned to supply vessel 14.

Tobacco is thereafter removed from the impregnator and advantageously the entire batch of impregnated tobacco is passed to an insulated or refrigerated holding tank 38 although if desired, the tobacco can be passed directly to a heating zone. Upon removal from the impregnator, the tobacco will typically contain from about 0.5% to about 3.0% by weight, preferably less than about 0.7 to about 2.0% by weight, 1,1,1,2-tetrafluoroethane. At temperatures of between about 5° C. and about 80° C., preferably between about 10° C. and 50° C., 1,1,1,2-tetrafluoroethane will be retained in the tobacco in a sufficient amount for subsequent expansion of the tobacco for a time period of up to several minutes e.g., 2 to 10 minutes or longer, without the necessity of cooling or insulating the tobacco. While not wishing to be bound by theory, it is believed that the 1,1,1,2-tetrafluoroethane is retained by the tobacco because the molecular size of 1,1,1,2-tetrafluoroethane is relatively large and diffusion of 1,1,1,2-tetrafluoroethane out of the impregnated tobacco is relatively slow.

Returning to FIG. 1, the entire batch of impregnated tobacco is advantageously passed to holding tank 38 which is preferably insulated and/or refrigerated. Holding tank 38 is preferably sealed during storage of tobacco. Various recovery means (not shown) can be provided in combination with holding tank 38 for recovery of 1,1,1,2-tetrafluoroethane gas which escapes the impregnated tobacco during the holding period. Such recovery means can take the form of gas lines provided at the top or the bottom of the holding tank for continuously removing 1,1,1,2-tetrafluoroethane gas during the holding period.

Impregnated tobacco is passed directly from the holding tank Via a rotary star valve 40 into the lower portion 42 of an expansion zone. In the lower portion 42 of the expansion zone, the impregnated tobacco is mixed with a rapidly moving stream of hot gases which is provided via a heater (not shown) and fan 44. A source of steam 46 can be provided at a location upstream for mixing with gases which are being recirculated within the expander.

The tobacco is carried by the force of the hot gas stream upwardly through expansion zone 48 and into separator 50. During movement of the tobacco through expansion zones 42 and 48, the 1,1,1,2-tetrafluoroethane rapidly volatilizes from the tobacco resulting in the stable expansion of the tobacco.

The degree of heating of the tobacco within expansion zone 48 is advantageously kept to a minimum to avoid harming the tobacco flavor and/or to avoid excessive fines generation. Temperatures above 300° C. are preferably avoided in the expansion zone in order to prevent significant loss of flavor and excessive degradation of tobacco material, although the skilled artisan will recognize that such temperatures can be used, if desired. Advantageously, the expansion zone will contain heated gases at a temperature of between about 90° C. and about 300° C., preferably between about 100° C. and 270° C., most preferably between about 160° C. and 250° C.

Expanded tobacco within cyclone-type separator 50 falls to the bottom portion thereof and is continuously removed by rotary star valve 52. The expanded tobacco 54 is collected on any of various conventional tobacco recovery apparatus such as conveyor 58.

If desired, the expanded tobacco can be passed to a reordering zone and/or a 1,1,1,2-tetrafluoroethane stripping zone. The reordering process, as is well known to the skilled artisan, comprises a moisture treatment in which expanded tobacco is treated with steam, water vapor or the like in order to increase the moisture content of the tobacco to the desired range of 10%-13%. Typically, the expanded tobacco exiting separator 50 will contain only a minute amount of residual 1,1,1,2-tetrafluoroethane, for example, 0.15% by weight or less. Due to the high volatility of the 1,1,1,2-tetrafluoroethane under expansion conditions, the expanded tobacco will, in many cases, depending upon the conditions in the heating zone, such as expansion temperature and composition of the gas heating media, exit the expansion zone with a 1,1,1,2-tetrafluoroethane content of less than 0.10% by weight.

A portion of the hot gases in the expansion zone is removed via line 60 and is passed to a 1,1,1,2-tetrafluoroethane stripping zone 62. 1,1,1,2-tetrafluoroethane recovered in the stripping zone is passed via line 64 to the 1,1,1,2-tetrafluoroethane supply tank 14. A portion of the expansion gases, which may include 1,1,1,2-tetrafluoroethane volatilized from the tobacco, are recirculated via pipe 66 for use in expanding freshly impregnated tobacco.

Figure 2:
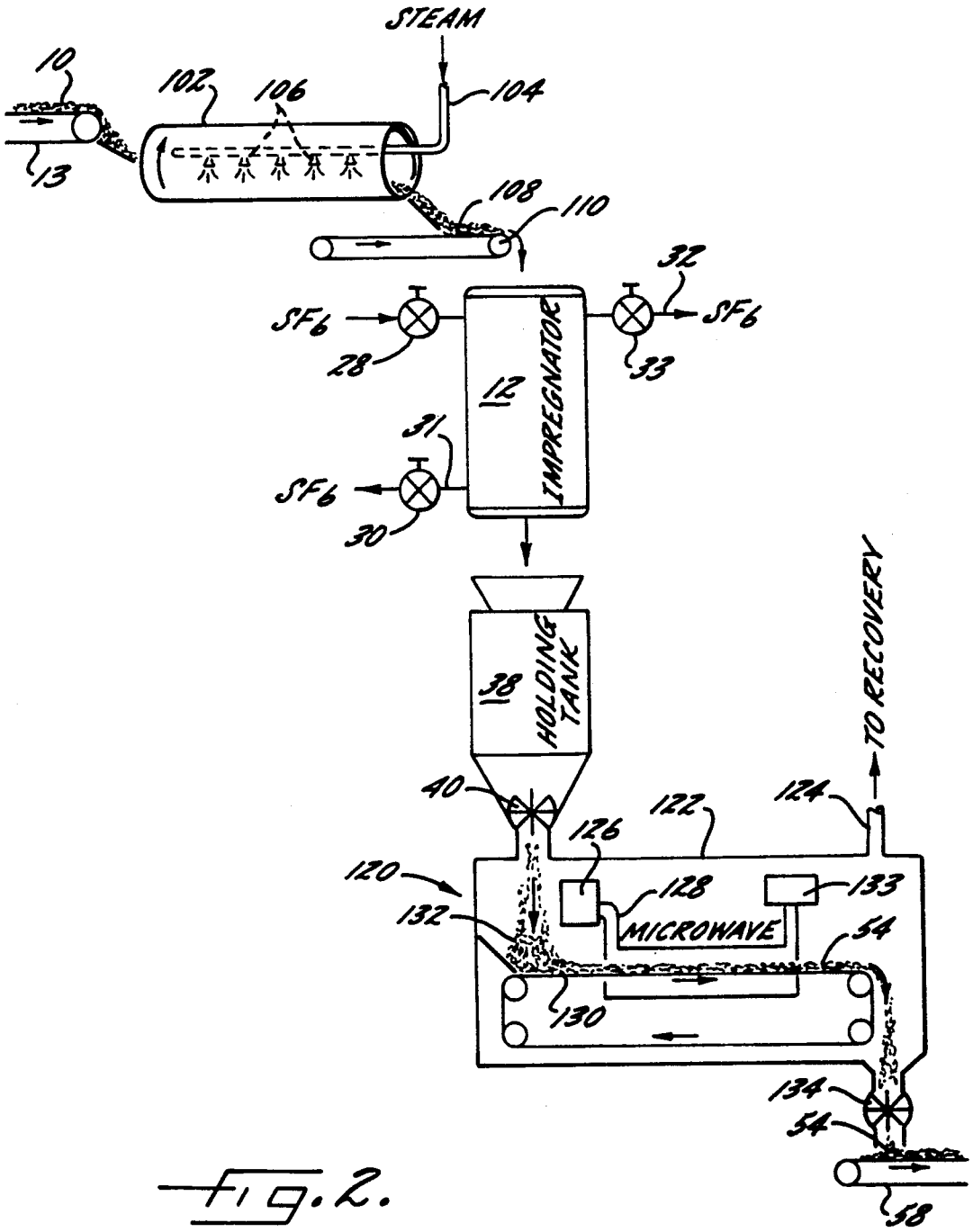
FIG. 2 schematically illustrates another preferred embodiment of the invention in which 1,1,1,2-tetrafluoroethane impregnated tobacco is expanded in a microwave heating zone.

FIG. 2 illustrates another preferred embodiment of the invention. Tobacco 10 is carried by conveyor 13, for admission into a conditioning drum 102. The tobacco 10 will typically have a moisture content of 12%-15% by weight, and as previously indicated, can have been previously treated by the application of casing or the like. Conditioning drum 102 includes a pipe 104 which admits steam or moisture into the interior thereof. A plurality of nozzles 106, shown in phantom, treat the tobacco inside the conditioning drum with steam or finely divided water. The drum rotates so that all of the tobacco particles are uniformly exposed to the steam or moisture. A plurality of interior flights or vanes (not shown) are preferably provided on the inside of rotating drum 102 so that tobacco is gently agitated while being treated in the conditioning drum. The tobacco is maintained within the conditioning drum for a period of time and under conditions sufficient to raise the equilibrium moisture of the tobacco to greater than 20% by weight, preferably greater than 25% by weight, most advantageously to between about 30% and about 40% by weight.

The treatment to increase moisture content provided in conditioning drum 102, is conducted in order to provide sufficient moisture in the tobacco for later absorption of microwave energy. It has been found that a moisture content in excess of 15% and up to 50% by weight, increases tobacco expansion in the process of the invention when microwave energy is employed for heating the tobacco. Particularly when the moisture content of the tobacco is to be increased to greater than about 25% by weight, the moisturizing conditioning process is conducted at a time close to the impregnation step, for example, from several minutes to several days prior to the impregnation step, preferably less than 24 hours prior to the impregnation step. This can prevent molding of the moist tobacco during storage.

The moistened tobacco 108 is removed from the conditioning drum and carried via a second conveyor 110 to impregnator 12 for the impregnation step in the manner described previously. Tobacco removed from impregnator 12 is then passed to holding tank 38 as previously described.

Impregnated tobacco is admitted via star valve 40 into a microwave treatment zone 120 for heating and expansion of the tobacco. The microwave treatment zone is preferably provided within a sealed chamber 122 so that 1,1,1,2-tetrafluoroethane volatized during the heat treatment can be recovered via line 124.

The microwave treatment zone includes a magnetron 126 which generates microwaves which are transported through waveguide 128. A conveyor belt 130 carries impregnated tobacco 132 through the waveguide 128 wherein the tobacco is exposed to microwaves for a period ranging from several seconds up to about a minute, for example, 5-20 seconds, to thereby heat the moisture in the tobacco which, in turn, volatizes the 1,1,1,2-tetrafluoroethane in the impregnated tobacco, causing the tobacco to expand. Any microwave energy which passes through the waveguide 128 and is not absorbed by the tobacco is received and absorbed by a conventional water load 133.

Expanded tobacco 54 is removed from the microwave treatment zone by conveyor 130 and passed via rotary star valve 134, to a conventional conveying means such as a conveyor belt 58. The expanded tobacco exiting the microwave treatment zone 120 advantageously has a moisture content in the range of between about 7% and about 13% by weight. The expanded tobacco can be passed to a conventional reordering treatment (not shown) and/or to a 1,1,1,2-tetrafluoroethane stripping zone; however, typically the tobacco will have a 1,1,1,2-tetrafluoroethane content of less than about 0.15% by weight so that recovery of the residual 1,1,1,2-tetrafluoroethane may be unnecessary.

Any of various commercially available microwave heating units may be employed for the microwave treatment of 1,1,1,2-tetrafluoroethane impregnated tobacco. An exposure time of 9-12 seconds has been employed in a 4.5-5.5 kilowatt treatment zone having a frequency of 2375 MHz and an efficiency of about 50% to treat ¼ to ½ pound per minute. When the bed depth of the impregnated tobacco is expected to exceed several inches, the microwave treatment zone can advantageously include an agitating means for agitating the tobacco during the microwave treatment to ensure that all of the tobacco is uniformly exposed to microwave energy and also to ensure that the impregnated tobacco is not excessively compressed during heating which could interfere with expansion of the tobacco. Such agitation means can include, for example, the use of a microwave-transparent rotary drum within the waveguide; gas lines for fluidizing the tobacco within the waveguide or the like. As will be apparent, the power of the microwave unit will be selected depending upon the amount of tobacco being treated. Exposure times can be increased or decreased also depending upon the amount of tobacco being treated. However, a short, relatively high energy treatment is preferred to ensure maximum tobacco expansion.

In the process of the invention wherein tobacco moisture is adjusted to above about 20% prior to the impregnation step, and particularly when microwave heating is employed, it is preferred that the moisture be fully equilibrated within the tobacco. For example, if the moisture content is increased simply by spraying ambient temperature moisture onto ambient temperature tobacco, the moisture will not rapidly penetrate into the structure of the tobacco. If subsequent microwave heating of the tobacco is conducted within only a few hours, the surface moisture can simply evaporate off of the tobacco without supplying sufficient heat to the 1,1,1,2-tetrafluoroethane within the interior of the tobacco to promote maximum expansion which would be achievable if the moisture were fully equilibrated into the tobacco. On the other hand, if the tobacco is treated by spraying with water and the moistened tobacco stored for a period of for example, 24 hours, the moisture will fully equilibrate through the cellular structure of the tobacco. Alternatively, treating the tobacco with moisture in the form of steam, as illustrated in FIG. 2, enhances the rate of moisture penetration into the tobacco.

As discussed previously, the impregnation step of the invention can be conducted over a wide range of temperatures and pressures. The time period for complete impregnation will depend, at least in part, upon the temperature and pressure employed during the impregnation step. Thus, higher temperatures and pressures tend to promote more rapid impregnation whereas lower temperatures and pressures can increase the amount of time required for impregnation. Generally, at impregnation temperatures above about 115° C. and impregnation pressures of between 1500 psi and 3000 psi, an impregnation time of less than about 5 minutes will be sufficient. Preferred impregnation temperatures range from about 115° C. up to as high as 130° C. to about 140° C. At these preferred temperatures, impregnation is rapid. Preferred impregnation pressures range from about 1,500 to about 3,000 psi, preferably between about 2,200 psi and about 2,500 psi.

Advantageously, temperature and pressure conditions within the impregnation zone are maintained so that all of the 1,1,1,2-tetrafluoroethane will be in the gas phase. Operation within the gas phase provides substantial contact between the 1,1,1,2-tetrafluoroethane and the tobacco thereby enhancing rapid and full impregnation.

Heating of the impregnated tobacco in order to effect expansion can be accomplished by means other than those discussed previously. Thus the impregnated tobacco can also be heated by radiant means to effect expansion. In another preferred embodiment, the tobacco can be heated in a fluidized bed with a stream of hot air or steam at a temperature of from about 90° C. up to about 300° C. Fluidized beds are known in the art and described for example in U.S. Pat. No. 4,270,553 to Conrad et al which is hereby incorporated herein by reference. The fluidized bed can be used with or without the added hot particles described in this patent.

If desired, various additives may be employed in the process of the invention. Thus, for example, the tobacco may be pretreated with various alcohols such as ethanol, or with other additives, for example hydrocarbons such as pentane or hexane, in order to promote better expansion.

The invention has been described in connection with various batch embodiments. However, a continual flow process may be used when employing an apparatus having slidably engaged ceramic seals at the entrance and exit ends thereof as described in U.S. patent application Ser. No. 07/367,589 filed June 19, 1989 by Anatoly I. Kramer entitled "Process and Apparatus for the Expansion of Tobacco" and assigned to the assignee of the present invention which is hereby incorporated herein by reference.

The following examples are provided for a more complete understanding of the invention and not by way of limitation. Tobacco moisture content as reported in the examples is expressed as the percent reduction in the tobacco weight upon heating in a convection oven for five minutes at 92° C. Filling capacity measurements of expanded and untreated tobacco samples were performed using a specially designed and electronically automated filling capacity meter in which a solid piston of 3.625 inches in diameter is slidably positioned in a cylinder and exerts a pressure of 26 psi on a tobacco sample located in the cylinder. These parameters are believed to simulate the packing conditions to which tobacco is subjected in cigarette making apparatus during the formation of a cigarette rod. The moisture content of tobacco affects the filling values determined by this method. Therefore, all expanded and unexpanded tobacco samples were submitted for moisture determination. These results were taken into account for calculating corrected filling capacities of tobacco samples through previously obtained correlation tables. Measured tobacco samples were as follows: 100 g for unexpanded tobacco and 50 g for expanded tobacco.

The percent increase in filling capacity or percent expansion as reported in the following examples was computed by subtracting the corrected filling capacity of the unexpanded control sample from the corrected filling capacity of the expanded sample, dividing this difference by the corrected filling capacity of the unexpanded control sample and multiplying this quotient times 100.

EXAMPLE 1

Samples of tobacco cut filler were impregnated in a pressure vessel having a volume of 2 liters. The pressure vessel included a thermocouple installed inside the vessel, close to the top thereof, to measure the temperature of the vessel contents and a pressure gauge for indicating the pressure in the vessel. 1,1,1,2-tetrafluoroethane was introduced into the vessel through a valve at the bottom of the vessel and removed from the vessel by two valves at the top of the vessel, by opening the valves and allowing the gas contents to escape. A thermostatically controlled heating jacket was provided around the vessel for heating during the impregnation.

A number of samples of tobacco, each weighing 120 grams were prepared. The tobacco samples consisted of a blend of cased flue cured and burley tobacco lamina in the form of cut filler. Moisture of the samples was recorded and measured as set forth below. The samples were then impregnated with 1,1,1,2-tetrafluoroethane for the times set forth below and at the temperature and pressures set forth below. Following impregnation, the tobacco was removed from the treating vessel and heated with a hot air at a temperature of about 230° C. The percent expansion achieved is as set forth below.

TABLE I

| P impr. PSI | T impr. C.° | t impr. time, min | Init. mois % | % exp |
|---|---|---|---|---|
| 1500 | 118 | 5:00 | 34.0 | 73 |
| 2000 | 119 | 5:00 | 34.0 | 85 |
| 3000 | 119 | 5:00 | 34.0 | 107 |
| 4000 | 133 | 0:00 | 26.0 | 81 |

TABLE I-continued

| P impr. PSI | T impr. C.° | t impr. time, min | Init. mois % | % exp |
|---|---|---|---|---|
| 2000 | 132 | 5:00 | 25.7 | 71 |
| 3000 | 130 | 5:00 | 25.7 | 125 |
| 2200 | 124 | 5:00 | 21.6 | 86 |
| 2500 | 126 | 5:00 | 21.6 | 92 |
| 3000 | 129 | 5:00 | 21.6 | 93 |

The invention has been described in considerable detail with specific reference to preferred embodiments. However, it will be apparent that variations and modifications can be made within the spirit and scope of the invention as described in the foregoing detailed specification and defined in the appended claims.

What is claimed is:

1. A process for expanding tobacco comprising the steps:

(a) impregnating tobacco in an impregnation zone with an expansion agent comprising 1,1,1,2-tetrafluoroethane at a pressure of at least 1500 psi;

(b) discharging impregnated tobacco from the impregnation zone the impregnated tobacco comprising at least about 0.5% by weight 1,1,1,2-tetrafluoroethane; and (c) heating the impregnated tobacco in an expansion zone under conditions effective to liberate the 1,1,1,2-tetrafluoroethane therein and cause expansion of the tobacco.

2. The process of claim 1 wherein the pressure in the impregnation zone is between about 2000 and about 3,000 psi.

3. The process of claim 1 Wherein the pressure within the impregnation zone is between about 2500 and about 3,000 psi.

4. The process of claim 1 wherein the temperature in the impregnation zone is maintained at least about 115° C. during the impregnating step.

5. The process of claim 1 wherein the temperature in the impregnation zone is maintained at least about 130° C. during the impregnating step.

6. The process of claim 1 wherein the impregnated tobacco discharged from the impregnation zone comprises at least about 1% by weight, 1,1,1,2-tetrafluoroethane.

7. The process of claim 1 wherein the impregnated tobacco discharged from the impregnation zone has a temperature within the range of between about 5° C. and 50° C.

8. The process of claim 1 wherein the impregnated tobacco discharged from the impregnation zone has a temperature in the range of between about 10° C. and about 30° C.

9. The process of claim 1 wherein the tobacco impregnated in the impregnation zone has an initial moisture content of greater than about 15% and about 50% by weight.

10. The process of claim 1 wherein the tobacco impregnated in the impregnation zone has an initial moisture content of between about 25% and about 40% by weight.

11. The process of claim 1 wherein the impregnated tobacco discharged from the impregnation zone is heated in the expansion zone at a temperature in the range of between about 90° C. and about 300° C.

12. The process of claim 11 wherein the impregnated tobacco is heated and expanded in the expansion zone by treating the tobacco with hot gases.

13. The process of claim 11 wherein the impregnated tobacco is heated in the expansion zone by exposing the impregnated tobacco to microwave energy.

14. The process of claim 1 wherein the impregnated tobacco is passed to a holding zone prior to the heating step, and is held in the holding zone for a period of between about 10 seconds and about 30 minutes.

15. A process for expanding tobacco comprising the steps:

(a) impregnating tobacco in an impregnation zone with an expansion agent comprising liquid 1,1,1,2-tetrafluoroethane;

(b) discharging impregnated tobacco from the impregnation zone, the impregnated tobacco being in a substantially pliable condition at a temperature of between about 5° C. and 50° C. and comprising at least about 0.5% by weight 1,1,1,2-tetrafluoroethane; and (c) heating the tobacco in an expansion zone under conditions effective to liberate the 1,1,1,2-tetrafluoroethane therein and cause expansion of the tobacco.

16. The process of claim 15 wherein the pressure in the impregnation zone is maintained at between about 1500 psi and about 3,000 psi.

17. The process of claim 16 wherein the temperature in the impregnation zone is maintained at a temperature above about 115° C.

18. The process of claim 15 wherein the impregnated tobacco discharged from the impregnation zone is at a temperature between about 10° C. and 30° C.

19. The process of claim 15 wherein the initial moisture content of the tobacco treated in the impregnation zone is between about 25% and about 40% by weight.

20. The process of claim 15 wherein the impregnated tobacco is heated in the expansion zone at a temperature of between about 90° C. and about 300° C.

21. The process of claim 20 wherein the tobacco is heated and expanded by means of a stream of hot gases.

22. The process of claim 20 wherein the impregnated tobacco is heated by treating the tobacco in a microwave heating zone.

23. The process of claim 15 wherein the tobacco is treated in the impregnation zone as a batch.

24. A process for expanding a tobacco comprising the steps:

(a) immersing cut filler tobacco lamina in gaseous 1,1,1,2-tetrafluoroethane in an impregnation zone maintained at a pressure of at least 300 psi and a temperature of at least 5° C. and 50° C.;

(b) recovering impregnated tobacco from the impregnation zone, the impregnated tobacco being in a substantially pliable condition at a temperature of at least about 102° C. and comprising at least about 0.5% 1,1,1,2-tetrafluoroethane absorbed within the cellular structure of the tobacco; and (c) heating the impregnated tobacco in an expansion zone at a temperature between about 90° C. and about 300° C. to thereby liberate the 1,1,1,2-tetrafluoroethane from the tobacco and cause expansion of the tobacco by at least 50%.

25. The process of claim 24 wherein the cut filler tobacco lamina treated in the impregnation zone has a moisture content of between about 25% and about 40% by weight.

26. The process of claim 25 wherein the moisture content is within the range of from about 25% to about 35% by weight.

27. The process of claim 25 wherein the pressure in the impregnation zone is maintained within the range of between about 2000 psi and about 3,000 psi.

28. The process of claim 27 wherein the temperature in the impregnation zone is maintained during the impregnation step at above about 115° C.

29. The process of claim 28 wherein the impregnated tobacco discharged from the impregnation zone has a temperature of less than about 30° C.

30. The process of claim 29 wherein the impregnated tobacco discharged from the impregnation zone has a 1,1,1,2-tetrafluoroethane content of at least 1.0% by weight.

31. A process for expanding tobacco comprising the steps:

(a) treating tobacco in a moisture conditioning zone to increase its moisture content to between about 20% and about 40% by weight;

(b) impregnating the treated tobacco in an impregnation zone with an expansion agent comprising 1,1,1,2-tetrafluoroethane;

(c) discharging impregnated tobacco from the impregnation zone, the impregnated tobacco being in a substantially pliable condition and comprising at least 0.5% by weight 1,1,1,2-tetrafluoroethane; and (d) heating the impregnated tobacco in a microwave heating zone under conditions effective to liberate the 1,1,1,2-tetrafluoroethane contained in the tobacco and thereby cause expansion of the tobacco.

32. A process for expanding tobacco comprising the steps:

(a) impregnating tobacco in an impregnation zone with an expansion agent comprising 1,1,1,2-tetrafluoroethane for a period of at least about 1 minute under conditions sufficient to cause the 1,1,1,2-tetrafluoroethane to permeate the tobacco;

(b) discharging impregnated tobacco from the impregnation zone, the impregnated tobacco being in a substantially pliable condition and being at a temperature of less than about 30° C. and comprising at least about 0.5% by weight 1,1,1,2-tetrafluoroethane; and (c) heating the impregnated tobacco in an expansion zone under conditions effective to liberate the 1,1,1,2-tetrafluoroethane from the tobacco and cause expansion of the tobacco by at least about 50%.

33. The process of claim 32 wherein the 1,1,1,2-tetrafluoroethane is maintained substantially in the liquid phase in the impregnation zone throughout the impregnating period of at least about 1 minute.

34. The process of claim 33 wherein the impregnated tobacco discharged from the impregnation zone has a 1,1,1,2-tetrafluoroethane content of at least about 1.0% by weight.

35. The process of claim 34 wherein the pressure within the impregnation zone is maintained within the range of between about 1500 psi and about 2,000 psi throughout the impregnating time period of greater than about 1 minute.

36. The process of claim 35 wherein the tobacco impregnated in the impregnation zone has a moisture content of between about 25% and about 40% by weight.

37. The process of claim 36 wherein the tobacco is heated in the expansion zone to a temperature of less than about 300° C.

38. The process of claim 37 wherein the tobacco is treated as a batch in the impregnation zone.

39. The process of claim 38 wherein the pressure in the impregnation zone is maintained at greater than about 1500 psi during the impregnating time period of greater than about 1 minute.

40. The process of claim 39 wherein the tobacco is impregnated in the impregnation zone for an impregnating time period of less than about 15 minutes.

41. An intermediate tobacco product comprising 100 parts by weight tobacco cut filler lamina and greater than about 0.5% by weight 1,1,1,2-tetrafluoroethane, the tobacco being substantially pliable and in substantially unextracted condition.

* * * * *